US005834998A

United States Patent [19]

Reiss et al.

[11] Patent Number: 5,834,998

[45] Date of Patent: Nov. 10, 1998

[54] ELECTROMAGNETIC RELAY

[75] Inventors: Heiko Reiss; Juergen Breitlow-Hertzfeldt, both of Berlin, Germany

[73] Assignee: Siemens Aktiengesellschaft, Munich, Germany

[21] Appl. No.: 824,772

[22] Filed: Mar. 26, 1997

[30] Foreign Application Priority Data

Mar. 26, 1996 [DE] Germany ..... 196 11 997.9

[51] Int. Cl.[6] ..... H01H 51/22

[52] U.S. Cl. ..... 335/78; 335/83; 335/202

[58] Field of Search ..... 335/78–86, 124, 335/128, 132, 202

[56] References Cited

U.S. PATENT DOCUMENTS 5,148,136 9/1992 Kidd ..... 335/83

5,173,675 12/1992 Leduc ..... 335/128

5,473,297 12/1995 Sako et al. ..... 335/83

FOREIGN PATENT DOCUMENTS 0 409 613 A2 7/1990 European Pat. Off. .

*Primary Examiner*—Lincoln Donovan

*Attorney, Agent, or Firm*—Hill & Simpson

[57] ABSTRACT

A relay with a base member accommodating a magnet system is provided whereby connecting leads are provided for a contact arrangement. A cap is mounted onto the base member and includes cap terminal lugs that are part of connecting webs in the inside of the cap. An unreleasable electrical connection is provided between the connecting webs and the connecting leads. One thus obtains a contact and/or coil connection possibility via the housing cap instead of or in addition to terminal lugs disposed on the underside of the base.

17 Claims, 3 Drawing Sheets

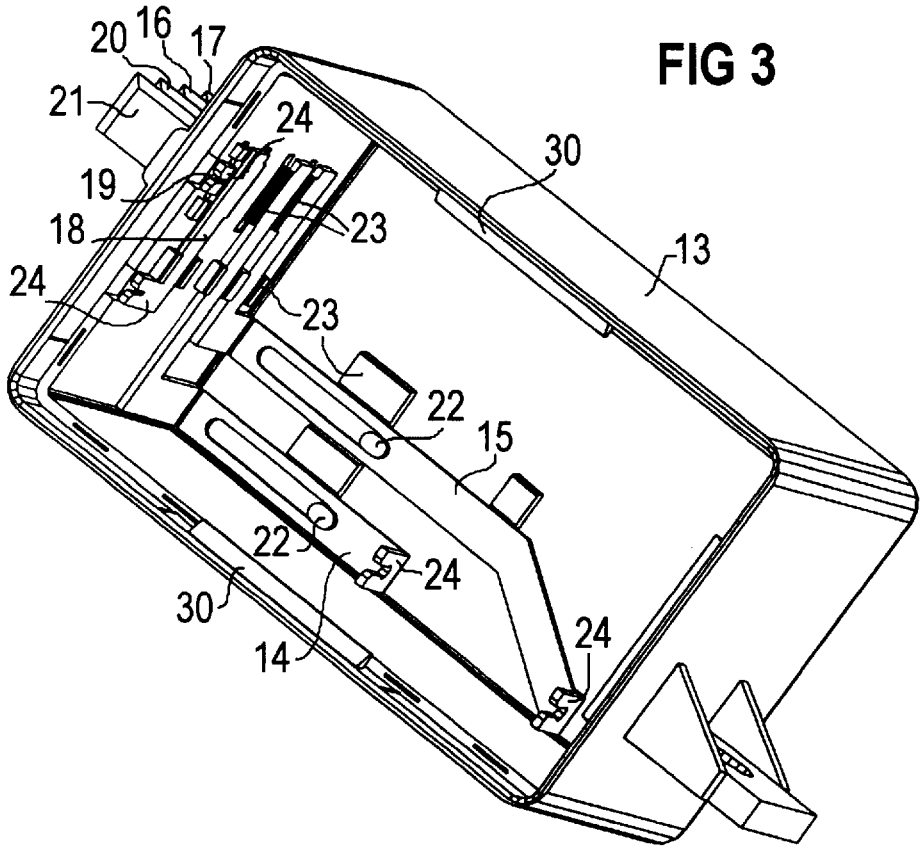
FIG 3
FIG 4
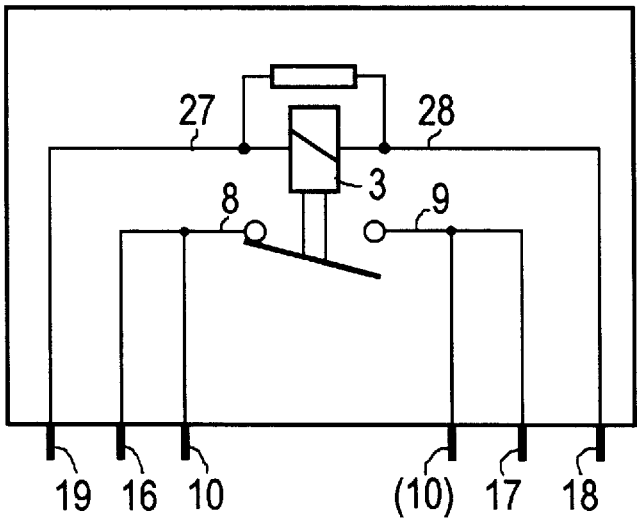

ELECTROMAGNETIC RELAY

FIELD OF THE INVENTION

The present invention is directed toward electromagnetic relays and, more specifically, toward electromagnetic relays comprising a base member that carries an electromagnetic system with a coil that is disposed underneath a cap that is plugged into the base member and further which includes connecting leads that extend through the cap.

BACKGROUND OF THE INVENTION

EP-A2-0 409 613 discloses a relay, whereby the contact carriers respectively comprise solder terminal pins that extend through a bottom plate and additionally that comprise flat plug terminals that extend through slots in a housing cap. In order for the flat plugs to be guided through the provided slots during mounting of the cap, their longitudinal axes must extend in the plug-on direction. Further, the slots in the cap must provide appropriate clearances for compensating tolerances. These design requirements unduly limit the design possibilities for the relay. Also, since these flat plugs are directly applied to the contact carriers, a mechanical decoupling between the contact elements and the flat plugs exposed to the external plugging forces is lacking.

SUMMARY OF THE PRESENT INVENTION

To overcome the deficiencies of the prior art, the invention is directed to an electromagnetic relay having a base member that, directly or indirectly, carries an electromagnet system with a coil, a core yoke as well as an armature and a contact arrangement actuatable by the armature as well as connecting leads for the contact arrangement and the coil, and with a cap that can be plugged onto the base member, whereby at least a part of the connecting leads are connected to cap terminal lugs that extend through the cap.

An object of the present invention is to structurally fashion a relay of the species disclosed in Ep-A2-0 409 613 so that terminal elements in the cap region can be provided at arbitrary sides. Such a design would ensure a simple plug-on of the cap but not create any additional sealing problems in the cap and would also enable a mechanical decoupling from the actual contact carriers insofar as contact terminals are involved.

This object is inventively achieved in that electrically conductive connecting webs are secured in the cap, each of these being connected, on the one hand, to a cap terminal lug projecting toward the cap outside and, on the other hand, forming a plug-type connector element in the inside of the cap that resides opposite a complementary plug-connector element of a connecting lead on the base member and proceeds into engagement therewith when the cap is plugged on.

A critical feature of the invention is that the cap terminal elements are not comprised of one piece and are not rigidly connected to the base member or terminal elements anchored in the base member to be plugged through openings in the cap and the cap terminal elements can be dimensioned more or less liberally during assembly. Instead, the terminal lugs are rigidly connected to the cap and, when the cap is mounted on the ease member, the terminal lugs are automatically contacted to the terminal elements disposed on the base member. It would therefore be conceivable to fashion this contacting as a releasable plug-type connection. Fundamentally, however, it is not thereby a matter of a plug-type connection but of a more or less unreleasable connection in the form of pinch contacts that are brought into engagement with one another upon permanent deformation, so that they penetrate one another and enter into a durable connection. Preferably, the plug-type connection elements are unreleasably connected to one another in a blade/clamp connection as is standard, for example, for the terminal contacting of plug-type connectors.

In an embodiment, the connecting webs can proceed along the inside surface of the cap and can be secured thereto with fastening sections. For example, this can be accomplished with shaped fastening pegs with catch fastenings or in some other way.

In an embodiment, the connecting webs can be at least partially embedded into the material of the cap.

In an embodiment, the lead-through of the cap terminal lugs can be tightly implemented during manufacture of the cap by embedding or in the pre-assembly of the cap terminal lugs, since no relative movement between the cap terminal lugs and the cap itself is required when the cap is plugged onto the base member.

The cap terminals lugs can be provided either as additional terminals for the contacts or, respectively, for the coil winding or as individual terminals as well. Accordingly, the connecting leads of the contact arrangement and/or of the coil can also form additional base terminal lugs conducted toward the outside from the base member.

Insofar as it is mentioned in this context that the complementary plug-connector elements are arranged on the base member opposite the plug-type connector elements of the cap, of course, the complimentary plug-connector elements can also be anchored in a coil member that is rigidly arranged on the base member. It would also be conceivable that a coil member itself forms a base member that carries the connecting leads for the contacts.

BRIEF DESCRIPTION OF THE DRAWINGS

The invention is explained in greater detail below with reference to an exemplary embodiment illustrated in the drawings wherein:

FIG. 3 is a bottom perspective view of the cap first illustrated in FIG. 1; and FIG. 4 is a circuit diagram for the relay illustrated in FIG. 1.

DETAILED DESCRIPTION OF THE PRESENTLY PREFERRED EMBODIMENT

Figure 1:
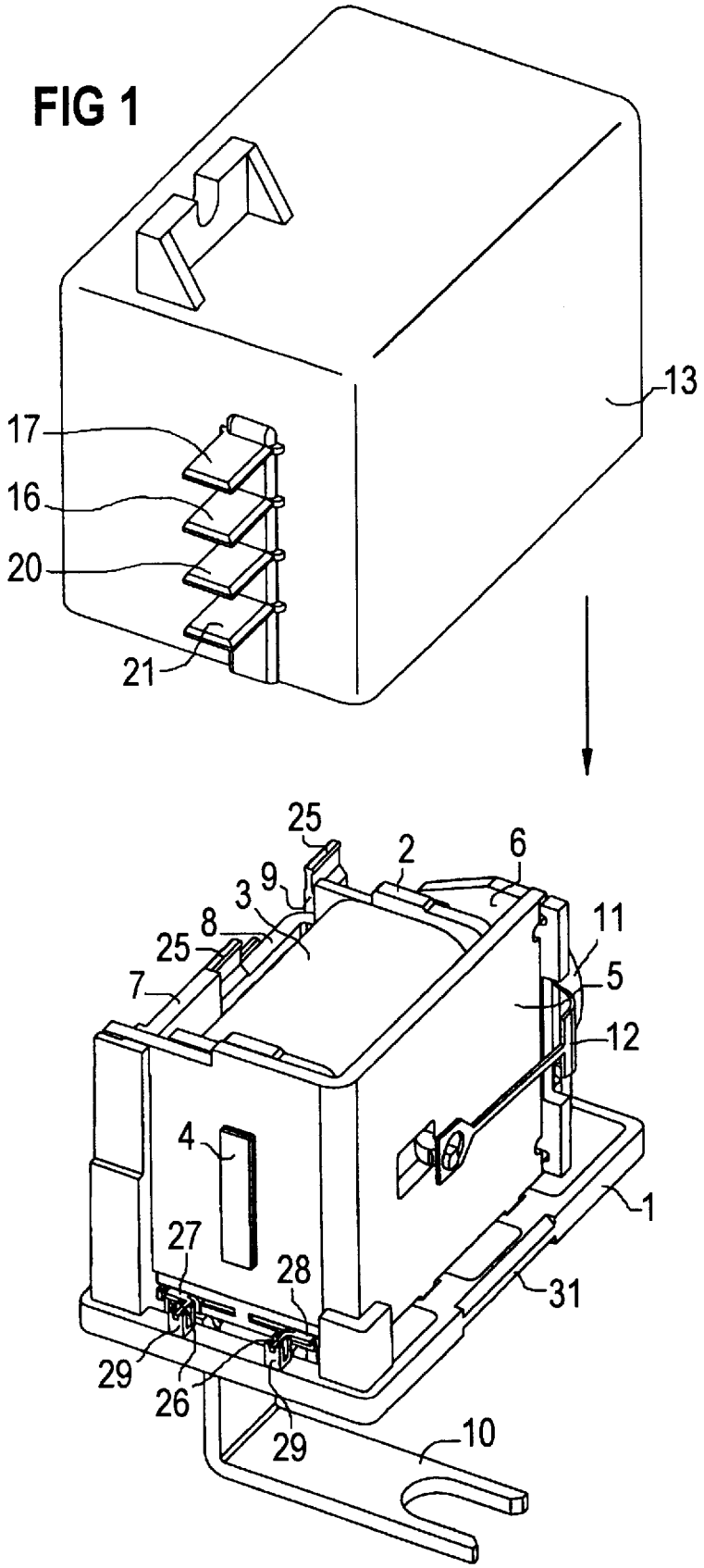
FIG. 1 is an exploded perspective view of a relay of the present invention.
Figure 2:
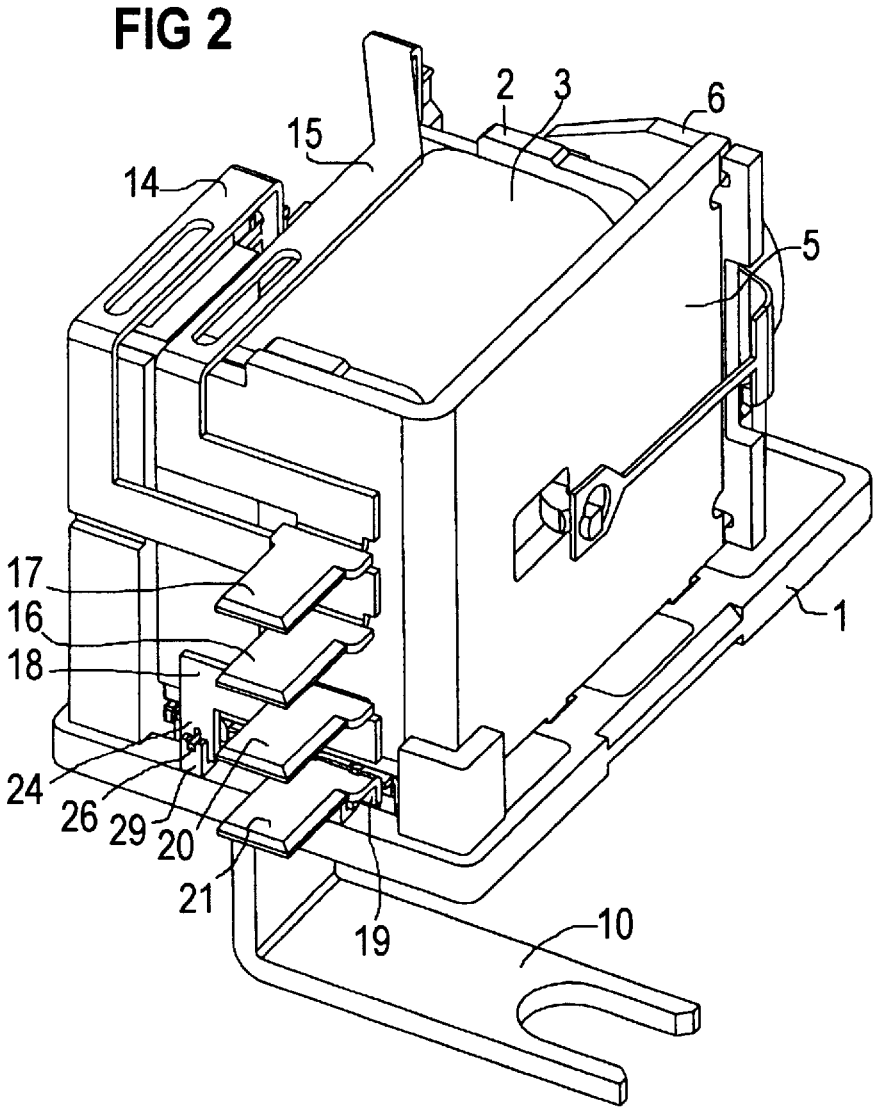
FIG. 2 is a perspective view of the relay shown in FIG. 1 with the cap portion removed.

The relay shown in FIGS. 1 and 2 has a structure with a base 1 on which the magnet system with a coil body 2 as carrier by a winding 3, as well as with a core 4, an angled-off yoke 5 and an armature 6 is arranged. Respective contact connecting leads 8 and 9 are anchored in the base 1 or, respectively, in a side wall 7 connected to the base 1. These contact connecting leads 8 and 9 are connected to the terminal lugs 10 (only one of which can be seen) emerging from the underside of the base 1. The connecting lead 8 carries a fixed contact (not shown in FIGS. 1 or 2), whereas the connecting lead 9 is connected via a stranded conductor 11 to a contact spring 12 or, respectively, to a movable contact secured on the contact spring. The contact spring 12 is connected to the armature 6 and is actuated by the armature 6 in a standard way.

In order to enable a parallel tapping of the load circuit in addition to the base terminal lugs 10, for example for diagnostic inquiries, for connection of a printed circuit board or for other applications, electrically conductive connecting webs 14 and 15 for the load circuit are additionally provided in a cap 13 that forms a closed housing together with the base 1. These connecting webs 14 and 15 are respectively connected to the flat plugs 16 and 17 that project outwards through the cap 13. Moreover, further connecting webs 18 and 19 with flat plugs 20 and 21 connected toward the outside as coil terminals are provided in the cap. All connecting webs in the cap are conducted along the inside surface of the cap 13 and are secured with retaining pegs 22 or, respectively, retaining webs 23. Each of the connecting web 14, 15, 18, 19 has a fork-shaped clamped tab 24 with a blade/clamp slot that is opened in plug-on direction of the cap. The clamp tabs 24 of the connecting webs 14 and 15 lie exactly above corresponding clamp webs 25 of the connecting leads 8 and 9, so that they respectively enter into a blade/clamp connection with these when the cap 13 is plugged on.

The clamp tabs 24 of the connecting webs 18 and 19 for the coil terminals correspondingly come to lie above clamp section 26 that are respectively part of two wrapping connectors 27 and 28 for the ends of the winding 3. The two blade/clamp sections 26 respectively lie on fork-shaped supports 29 of the base 1, so that they can withstand the pressure when the appertaining clamp tabs 24 are pressed on, so that a firm and durable blade/clamp connection arises.

Given the illustrated exemplary embodiment, the coil winding 3 thus only has terminals via the connecting webs 18 and 19 as well as the flat plugs 20 and 21, whereas the connecting leads 8, 9 have both face terminal lugs 10 as well as cap terminal lugs 16 and 17. As needed, of course, additional coil terminal elements can also be provided in the base.

The cap 13 latches to corresponding catch webs 31 of the base via catch noses 30. The blade/clamp connections between the connecting webs 14, 15, 18 and 19 and the corresponding contact connecting leads 8 and 9 as well as the wrapping connectors 27 and 28 are secured in this way. A set of illustrated, subsequent fastening of the connecting webs 14, 15, 18 and 19 at the inside surface of the cap 13, however, it would also be possible to already embed these connecting webs into the walls of the cap when the cap is manufactured.

FIG. 4 shows a circuit diagram of the illustrated relay with its terminals. It may be seen therefrom that the load circuit of the contact connecting leads 8 and 9 is respectively connectable via base terminal lugs 10 and cap terminal lugs 16 or, respectively, 17 connected parallel, whereas the coil circuit of the winding 3 can be connected via the wrapping connectors 27 and 28 only to the cap terminal lugs 18 and 19.

It should be understood that the various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed:

1. An electromagnetic relay comprising:

a base member comprising an upper surface and a lower surface, the upper surface of the base member accommodating an electromagnet system, the upper surface of the base member being connected to a cap that covers the electromagnet system, the cap and the base providing a housing for the electromagnet system, the electromagnetic system comprising a coil, a core yoke, a contact spring, an armature and a plurality of fixed connecting leads, each fixed connecting lead being connected to one of a plurality of terminal lugs that extend through the upper surface to the lower surface of the base, the cap comprising an inside surface and an outside surface, the inside surface of the cap accommodating a plurality of spaced apart connecting webs, the outside surface of the cap being connected to a plurality of cap lugs, each connecting web providing an electrical connection between one of the connecting leads of the electromagnet system and one of the cap lugs.

2. The electromagnetic relay of claim 1 wherein each connecting web further comprises a plug connector and each connecting lead comprises an upwardly protruding tab, each plug connector of a connecting web engaging a tab of a respective connecting lead when the cap is pushed downward over the electromagnetic system and onto the upper surface of the base member.

3. The electromagnetic relay of claim 2 wherein the plug connectors and tabs connected in a blade/clamp connection when the cap is mounted over the electromagnet system an onto the upper surface of the base member.

4. The electromagnetic relay of claim 2 wherein the plug connectors are unreleaseably connected to the tabs when the cap is mounted over the electromagnet system an onto the upper surface of the base member.

5. The electromagnetic relay of claim 1 wherein each connecting web further comprises a downwardly extending tab and each connecting lead comprises an upwardly protruding plug connector, each tab of a connecting web engaging a plug connector of a respective connecting lead when the cap is pushed downward over the electromagnetic system and onto the upper surface of the base member.

6. The electromagnetic relay of claim 5 wherein the plug connectors and tabs are partially deformed when the cap is mounted over the electromagnet system an onto the upper surface of the base member.

7. The electromagnetic relay of claim 5 wherein the plug connectors are unreleaseably connected to the tabs when the cap is mounted over the electromagnet system an onto the upper surface of the base member.

8. The electromagnetic relay of claim 1 wherein the connecting webs are fixedly connected to the inside surface of the cap.

9. The electromagnetic relay of claim 1 wherein the connecting webs are secured the inside surface of the cap with heat-deformed fastening pegs.

10. The electromagnetic relay of claim 1 wherein the connecting webs are secured the inside surface of the cap with fastening webs.

11. The electromagnetic relay of claim 1 wherein the connecting webs are at least partially embedded into the inside surface of the cap.

12. An electromagnetic relay comprising:

a base member comprising an upper surface, the upper surface of the base member accommodating an electromagnet system, the upper surface of the base member being connected to a cap that covers the electromagnet system, the cap and the base providing a housing for the electromagnet system, the electromagnet system comprising a plurality of connecting leads each connecting lead being connected to one of a plurality of terminal lugs disposed underneath the base, the cap comprising an inside surface and an outside surface, the inside surface of the cap accommodating a plurality of connecting webs, the outside surface of the cap being connected to a plurality of cap lugs, each connecting web providing an electrical connection between one of the connecting leads and one of the cap lugs when the cap is pushed downward over the electromagnetic system and the base.

13. The electromagnetic relay of claim 12 wherein each connecting web further comprises a plug connector and each connecting lead comprises an upwardly protruding tab which engages the respective plug connector of the respective connecting web when the cap is pushed downward over the electromagnetic system and onto the upper surface of the base member.

14. The electromagnetic relay of claim 13 wherein the plug connectors and tabs are connected in a blade/clamp connection when the cap is mounted over the electromagnetic system an onto the upper surface of the base member.

15. The electromagnetic relay of claim 12 wherein each connecting web further comprises a downwardly extending tab and each connecting lead comprises an upwardly protruding plug connector, each tab of a connecting web engaging a plug connector of a respective connecting lead when the cap is pushed downward over the electromagnetic system and onto the upper surface of the base member.

16. The electromagnetic relay of claim 15 wherein the plug connectors and tabs are partially deformed when the cap is mounted over the electromagnet system and onto the upper surface of the base member.

17. An electromagnetic relay comprising:

a base member comprising an upper surface and a lower surface, the upper surface of the base member accommodating an electromagnet system, the upper surface of the base member being connected to a cap that covers the electromagnet system, the cap and the base providing a housing for the electromagnet system, the lower surface of the base accommodating a plurality of terminal lugs, the electromagnet system comprising a plurality of spaced apart connecting leads, each connecting lead comprises an upwardly protruding tab, the cap comprising an inside surface and an outside surface, the inside surface of the cap accommodating a plurality of spaced apart connecting webs, the connecting webs being secured the inside surface of the cap with heat-deformed fastening pegs, each connecting web further comprises a plug connector, each plug connector of a connecting web engaging a tab of a respective connecting lead when the cap is pushed downward over the electromagnetic system and onto the upper surface of the base member, the plug connectors and tabs being partially deformed when the cap is mounted over the electromagnet system and onto the upper surface of the base member, the outside surface of the cap being connected to a plurality of cap lugs, each connecting web providing an electrical connection between a connecting lead of the electromagnet system and a cap lug, each terminal lug being electrically connected one of the connecting leads.

* * * * *